US009850813B2

(12) United States Patent
Hiyoshi et al.

(10) Patent No.: US 9,850,813 B2
(45) Date of Patent: Dec. 26, 2017

(54) VARIABLE COMPRESSION RATIO INTERNAL COMBUSTION ENGINE

(71) Applicant: NISSAN MOTOR CO., LTD., Yokohama-shi, Kanagawa (JP)

(72) Inventors: Ryosuke Hiyoshi, Kanagawa (JP); Yoshiaki Tanaka, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 15/325,098

(22) PCT Filed: Jul. 14, 2014

(86) PCT No.: PCT/JP2014/068659

§ 371 (c)(1),
(2) Date: Jan. 10, 2017

(87) PCT Pub. No.: WO2016/009468

PCT Pub. Date: Jan. 21, 2016

(65) Prior Publication Data

US 2017/0191409 A1 Jul. 6, 2017

(51) Int. Cl.
*F02B 75/04* (2006.01)
*F02D 15/02* (2006.01)

(52) U.S. Cl.
CPC ..... *F02B 75/045* (2013.01); *F02D 15/02* (2013.01)

(58) Field of Classification Search
CPC ..... F02B 75/045; F02B 75/047; F02D 15/02
USPC ..... 123/48 B, 78 E, 78 F
See application file for complete search history.

(56) References Cited

U.S. PATENT DOCUMENTS 6,789,515 B1 * 9/2004 Marchisseau ..... F02B 75/04 123/48 C
7,174,865 B2 * 2/2007 Sakita ..... F02B 75/047 123/197.4
8,844,479 B2 9/2014 Hiyoshi
2004/0134452 A1 7/2004 Yamada
2006/0180118 A1 8/2006 Takemura et al.
(Continued)

FOREIGN PATENT DOCUMENTS

JP 2004-150286 A 5/2004
JP 2006-226133 A 8/2006
JP 2009-185629 A 8/2009
(Continued)

*Primary Examiner* — Hung Q Nguyen
(74) *Attorney, Agent, or Firm* — Drinker Biddle & Reath LLP

(57) ABSTRACT

A variable compression ratio internal combustion engine includes a control shaft rotatably supported by an engine body, a variable compression ratio mechanism, an actuator for driving the control shaft, and a speed reducing mechanism for reducing a rotational power of the actuator and for transmitting the speed-reduced power to the control shaft, and structured to have a rotation shaft rotatably supported in a housing fixed to the engine body and a lever that connects the rotation shaft and the control shaft. Located in the engine body is a first regulation part for mechanically regulating the control shaft to a position of maximum rotation on a high compression ratio side. Also located in the housing is a second regulation part for mechanically regulating the rotation shaft to a position of maximum rotation on a low compression ratio side.

7 Claims, 2 Drawing Sheets

(56) References Cited

U.S. PATENT DOCUMENTS

2013/0306035 A1 11/2013 Hiyoshi et al.

FOREIGN PATENT DOCUMENTS

| | | | |
|---|---|---|---|
| JP | 2011-169152 | A | 9/2011 |
| JP | 2013-253512 | A | 12/2013 |
| WO | WO-2013/080673 | A1 | 6/2013 |
| WO | WO 2014/027497 | | 2/2014 |

* cited by examiner

VARIABLE COMPRESSION RATIO INTERNAL COMBUSTION ENGINE

TECHNICAL FIELD

The present invention relates to a control device for a variable compression ratio internal combustion engine provided with a variable compression ratio mechanism capable of changing an engine compression ratio in accordance with a rotational position of a control shaft.

BACKGROUND ART

Patent document 1 discloses an internal combustion engine (hereinafter referred to as "variable compression ratio internal combustion engine") provided with a variable compression ratio mechanism capable of changing an engine compression ratio in accordance with a rotational position of a control shaft. A speed reducing mechanism is provided between the control shaft and an actuator such as a motor that drives the control shaft. A rotation shaft, which is linked through a lever to the control shaft, is provided in the speed reducing mechanism. For example, the rotation shaft is rotatably supported in a housing fixed to an engine body.

CITATION LIST

Patent Literature

Patent document 1: Japanese Patent Provisional Publication No. JP2013-253512

SUMMARY OF INVENTION

Technical Problem

In such a variable compression ratio internal combustion engine, a high compression ratio side regulation part and a low compression ratio side regulation part are provided in the housing that rotatably supports the rotation shaft, for mechanically regulating a rotatable range of the rotation shaft between a high compression ratio side and a low compression ratio side. Also, compression ratio reference position learning operation is carried out, based on a detection signal from a rotation sensor that detects a rotational position of the rotation shaft, in a state where the rotational position of the rotation shaft has been regulated and positioned mechanically by means of either of these two regulation parts.

However, the regulation parts and the rotation sensor are provided in the same housing, and thus there is a possibility that the detection accuracy of the rotation sensor deteriorates owing to vibrations, deformation and the like, occurring when the control shaft is brought into collision with a stopper face of each of the regulation parts, thus resulting in a deterioration in the compression ratio reference position learning accuracy.

It is, therefore, in view of the previously-described circumstances, an object of the present invention to improve the compression ratio reference position learning accuracy in a variable compression ratio internal combustion engine provided with a variable compression ratio mechanism.

Solution to Problem

A variable compression ratio internal combustion engine of the present invention includes a control shaft rotatably supported by an engine body, a variable compression ratio mechanism for changing an engine compression ratio in accordance with a rotational position of the control shaft, an actuator that rotatively drives the control shaft, and a speed reducing mechanism for reducing a rotational power of the actuator and for transmitting the speed-reduced power to the control shaft. The speed reducing mechanism has a rotation shaft rotatably supported in a housing fixed to the engine body and a lever that connects the rotation shaft and the control shaft.

The variable compression ratio internal combustion engine has a first regulation part located in the engine body for mechanically regulating the control shaft to a position of maximum rotation on one side of a low compression ratio side and a high compression ratio side and a second regulation part located in the housing for mechanically regulating the rotation shaft to a position of maximum rotation on the other side of the low compression ratio side and the high compression ratio side.

The first regulation part is configured to regulate the control shaft to the position of maximum rotation on the high compression ratio side, whereas the second regulation part is configured to regulate the rotation shaft to the position of maximum rotation on the low compression ratio side.

Preferably, the variable compression ratio internal combustion engine has a rotation sensor for detecting a rotational position of one shaft of the control shaft and the rotation shaft, and a reference position learning means for carrying out compression ratio reference position learning operation, based on a detection signal from the rotation sensor, in a state where the other shaft of the control shaft and the rotation shaft has been mechanically regulated by either the first regulation part or the second regulation part.

Advantageous Effects of Invention

According to the present invention, the first regulation part and the second regulation part are located individually on the engine body side where the control shaft is installed and on the housing side where the rotation shaft is installed, for regulating a rotatable range between the high compression ratio side and the low compression ratio side. Hence, the degree of freedom in layout is high. For instance when carrying out compression ratio reference position learning operation through the use of the rotation sensor, it is possible to suppress a deterioration in the detection accuracy of the rotation sensor by bringing either the control shaft or the rotation shaft into a mechanically-regulated state by means of the regulation part not provided with the rotation sensor, thus improving the compression ratio reference position learning accuracy.

DESCRIPTION OF EMBODIMENTS

Figure 1:
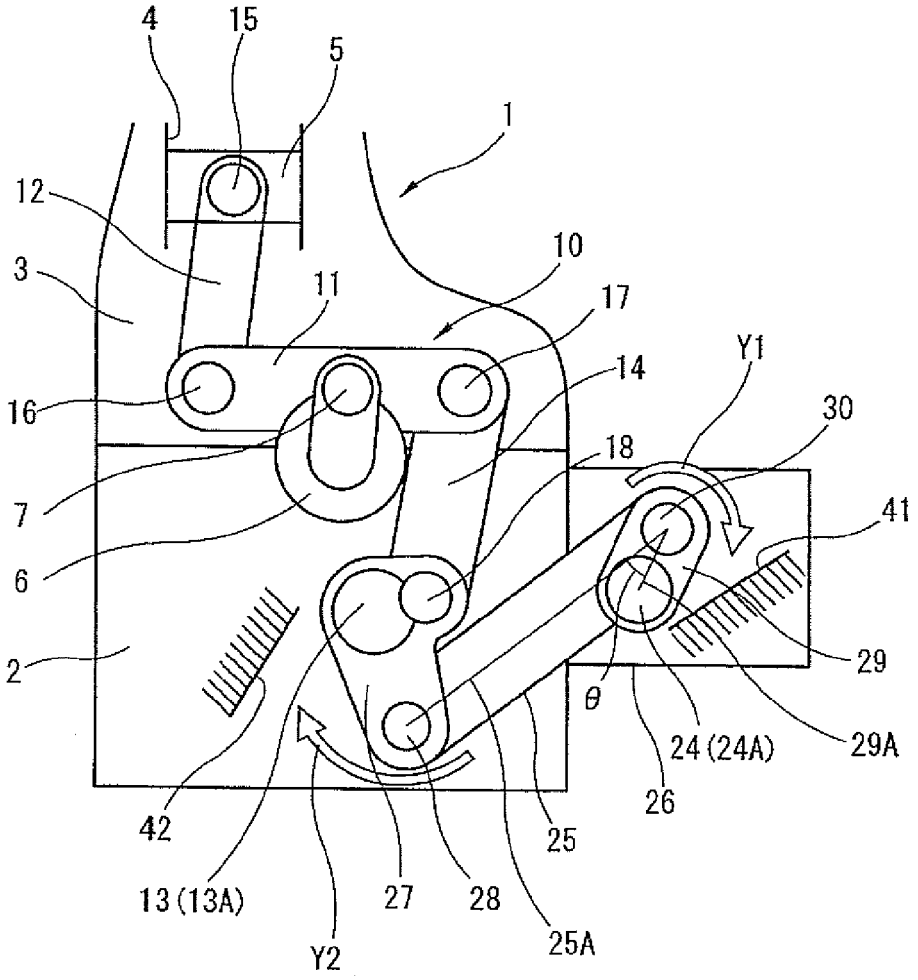
FIG. 1 is a diagram schematically illustrating the configuration of a control device for a variable compression ratio internal combustion engine provided with a variable compression ratio mechanism in one embodiment to which the invention is applied.
Figure 2:
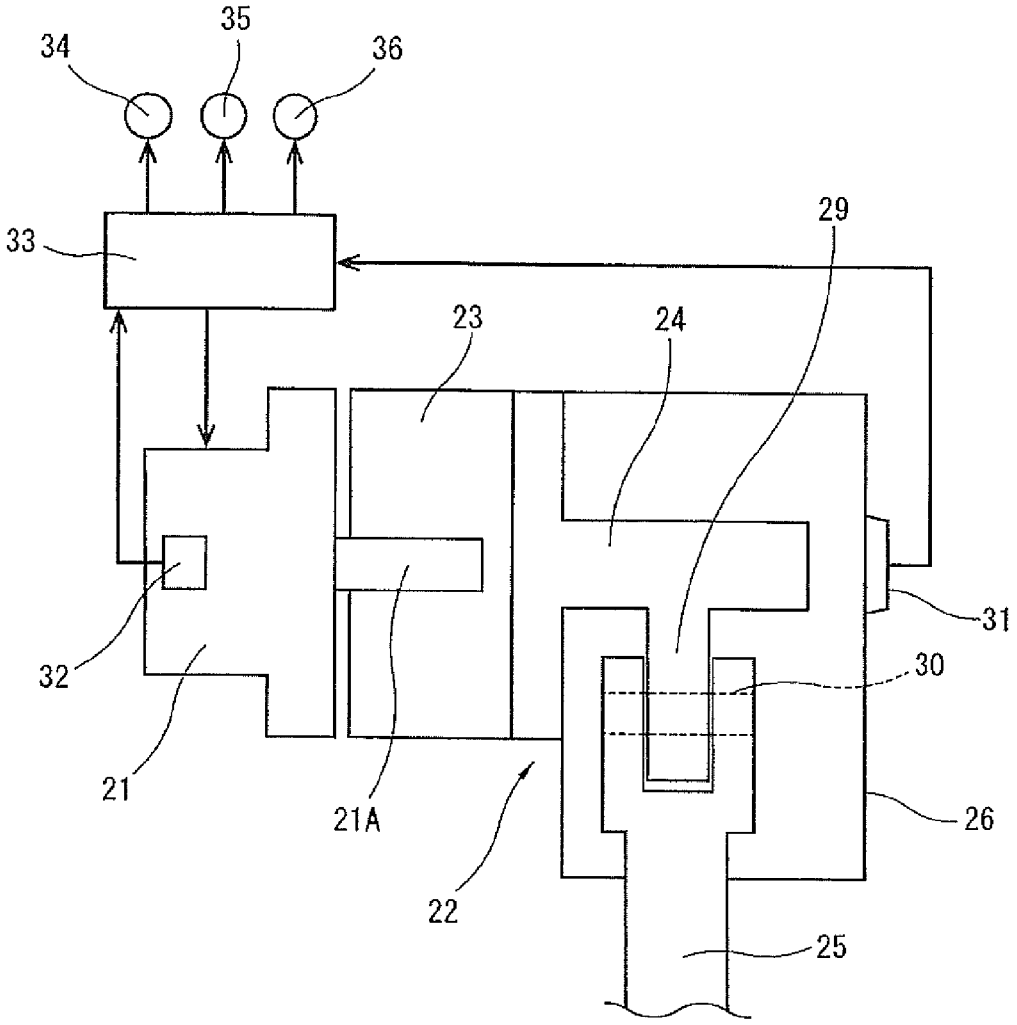
FIG. 2 is a diagram schematically illustrating the configuration of the control device for the variable compression ratio internal combustion engine of the embodiment.

Hereinafter explained in reference to FIGS. 1 to 2 is a control device for a variable compression ratio internal combustion engine 1 provided with a variable compression ratio mechanism 10 in one embodiment according to the present invention.

With reference to FIG. 1, variable compression ratio internal combustion engine 1 is mainly constructed by a cylinder block 2 serving as an engine body and a cylinder head 3 fixed onto the cylinder block 2. A piston 5 is liftably (slidably) fitted into a cylinder 4 of the cylinder head 3.

Variable compression ratio mechanism 10 has a lower link 11, an upper link 12, a control shaft 13, and a control link 14. The lower link is rotatably installed on a crankpin 7 of a crankshaft 6. The upper link is configured to connect the lower link 11 and the piston 5. The control shaft is rotatably supported on the cylinder block 2. The control link is configured to connect the control shaft 13 and the lower link 11. The upper end of upper link 12 and the piston 5 are connected to each other by means of a piston pin 15 so as to permit relative rotation between them. Upper link 12 and lower link 11 are connected to each other by means of a first connecting pin 16 so as to permit relative rotation between them. Lower link 11 and the upper end of control link 14 are connected to each other by means of a second connecting pin 17 so as to permit relative rotation between them. The lower end of lower link 11 is rotatably installed on a control eccentric shaft 18 provided eccentrically to a journal portion 13A serving as the rotation center of control shaft 13.

As shown in FIG. 2, a speed reducing mechanism 22 is interposed in a power-transmission path between the control shaft 13 and an output shaft 21A of a motor 21, serving as an actuator that rotatively drives the control shaft 13, for reducing a rotational power of the output shaft 21A of motor 21 and for transmitting the speed-reduced power to the control shaft 13. Speed reducing mechanism 22 has a speed reducer 23 such as a wave motion gear device that provides high reduction ratios, a rotation shaft 24 that rotates integrally with the output shaft of speed reducer 23, and a lever 25 configured to connect the rotation shaft 24 and the control shaft 13 (see FIG. 1). Rotation shaft 24 is accommodated and arranged inside of a housing 26 fixedly connected to and located alongside the cylinder block 2. The rotation shaft is rotatably supported inside of the housing 26 and arranged parallel to the control shaft 13. Lever 25 is structured to extend through slits of cylinder block 2 and housing 26.

One end of lever 25 and the top end of a first arm 27 extending radially from the journal portion 13A of control shaft 13 are connected to each other by means of a third connecting pin 28 so as to permit relative rotation between them. The other end of lever 25 and the top end of a second arm 29 extending radially from a journal portion 24A serving as the rotation center of rotation shaft 24 are connected to each other by means of a fourth connecting pin 30 so as to permit relative rotation between them.

In the variable compression ratio mechanism 10 constructed as discussed above, when the rotational position of control shaft 13 is changed by means of the motor 21 through the speed reducing mechanism 22, a change in the attitude of lower link 11 occurs and thus a change in stroke characteristic of piston 5 including a piston top dead center (TDC) position and a piston bottom dead center (BDC) position occurs. In this manner, an engine compression ratio is continuously changed.

With reference to FIG. 2, as a compression ratio detection unit that detects an actual compression ratio which is an actual engine compression ratio, a rotation sensor 31 is installed on the housing 26 for detecting a rotational position of rotation shaft 24 corresponding to the actual compression ratio, that is, a compression ratio reference position. Also, a motor speed detection sensor 32 is installed on the motor 21 for detecting a motor speed.

A control unit 33 is a digital computer system capable of storing and executing various control processes. The control unit is configured to output control signals to various actuators based on an engine operating condition detected by sensors 31, 32 and the like, for integrally controlling respective operations of these actuators. Concretely, the control unit is configured to control driving of a variable valve timing mechanism 34 capable of changing intake valve timing (or exhaust valve timing), for controlling intake valve open timing (IVO) and intake valve closure timing (IVC). Also, the control unit is configured to control driving of a spark plug 35 that spark-ignites an air-fuel mixture in the combustion chamber, for controlling ignition timing. Furthermore, the control unit is configured to control driving of an electronically-controlled throttle 36 that opens or closes an intake-air passage, for controlling throttle opening.

Additionally, control unit 33 is configured to set a target compression ratio based on the engine operating condition, and feedback-control the operation of motor 21 for maintaining the deviation between the target compression ratio and the actual compression ratio detected by the rotation sensor 31 as small as possible.

As schematically shown in FIG. 1, a rotatable range of each of control shaft 13 and rotation shaft 24, both linked together in a manner so as to rotate in conjunction with each other, is mechanically regulated or limited by means of a low compression ratio side stopper face 41 serving as a low compression ratio side regulation part and a high compression ratio side stopper face 42 serving as a high compression ratio side regulation part. For instance, in the shown embodiment, the low compression ratio side stopper face 41 is provided inside of the housing 26. When rotation shaft 24 rotates toward a maximum low compression ratio side (i.e., in the direction indicated by the arrow "Y1" in FIG. 1), a side face of the second arm 29 is brought into abutted-engagement with the low compression ratio side stopper face 41. Hence, control shaft 13 and rotation shaft 24 are structured to be mechanically locked up and regulated at a low compression ratio side stopper position. On the other hand, the high compression ratio side stopper face 42 is provided inside of the cylinder block 2. When control shaft 13 rotates toward a maximum high compression ratio side (i.e., in the direction indicated by the arrow "Y2" in FIG. 1), a side face of the first arm 27 is brought into abutted-engagement with the high compression ratio side stopper face 42. Hence, control shaft 13 and rotation shaft 24 are also structured to be mechanically locked up and regulated at a high compression ratio side stopper position.

When a predetermined engine operating condition for carrying out initializing operation for rotation sensor 31 is satisfied (for example, immediately after an engine start or immediately before an engine stop), the initializing operation is carried out. In this initializing operation, for instance in a state where, with the rotation shaft 24 in abutted-engagement with the high compression ratio side stopper face 42, control shaft 13 has been mechanically regulated and locked up at the high compression ratio side stopper position serving as a reference position, a detected value of rotation sensor 31, corresponding to an actual compression ratio, is learned and initialized to a given initial value corresponding to the compression ratio reference position. By virtue of the learning and initializing operation, the correspondence relation between an actual rotational position of each of control shaft 13 and rotation shaft 24 and an actual compression ratio detected by rotation sensor 31 can be reset to an initial normal state.

The specified configuration of the embodiment and its operation and effects are hereunder enumerated.

(1) The variable compression ratio internal combustion engine has a high compression ratio side stopper face 42 located in the cylinder block 2 (serving as an engine body) and serving as a first regulation part (a first regulation structure) for mechanically regulating the control shaft 13 to a position of maximum rotation on one side of a low compression ratio side and a high compression ratio side and a low compression ratio side stopper face 41 located in the housing 26 and serving as a second regulation part (a second regulation structure) for mechanically regulating the rotation shaft 24 to a position of maximum rotation on the other side of the low compression ratio side and the high compression ratio side. In this manner, the high compression ratio side stopper face 42 and the low compression ratio side stopper face 41 are located individually on the side of control shaft 13 and on the side of rotation shaft 24, thus increasing the degree of freedom in layout. As described later, when carrying out compression ratio reference position learning operation, one shaft of the control shaft 13 and the rotation shaft 24, the one shaft being equipped with the rotation sensor 31, and the other shaft of the control shaft and the rotation shaft, the other shaft being configured such that a rotational position of the other shaft is mechanically regulated by means of either the stopper face 41 or the stopper face 42, can be different from each other. Hence, it is possible to carry out the learning operation without being affected by vibrations and deformation, caused by abutment-engagement of the other shaft with the stopper face, thus improving the detection accuracy during learning operation.

(2) In the shown embodiment, the high compression ratio side stopper face 42, serving as the first regulation part, is configured to regulate the control shaft 13 to the position of maximum rotation on the high compression ratio side, whereas the low compression ratio side stopper face 41, serving as the second regulation part, is configured to regulate the rotation shaft 24 to the position of maximum rotation on the low compression ratio side. That is, when carrying out learning operation, collision noise caused by collision with the stopper face can be reduced via an oil pan of the engine body by mechanically regulating the control shaft 13 by the high compression ratio side stopper face 42 provided on the engine body side, as compared to regulating action on the housing side. This contributes to a suppression of collision noise during learning operation. The learning operation is carried out or initiated by bringing the shaft into abutted-engagement with only one of the stopper faces 41, 42, thus shortening the learning time.

(3) Rotation sensor 31 is provided for detecting a rotational position of one shaft of the control shaft 13 and the rotation shaft 24. Compression ratio reference position learning operation is executed, based on a detection signal from the rotation sensor 31, in a state where the other shaft of the control shaft 13 and the rotation shaft 24 has been mechanically regulated by means of either the first regulation part or the second regulation part. As discussed above, when carrying out compression ratio reference position learning operation, one shaft of the control shaft 13 and the rotation shaft 24, the one shaft being equipped with the rotation sensor 31, and the other shaft of the control shaft and the rotation shaft, the other shaft being configured such that a rotational position of the other shaft is mechanically regulated by either the stopper face 41 or the stopper face 42, can be different from each other. Hence, it is possible to carry out the learning operation without being affected by vibrations and deformation, caused by abutment-engagement of the other shaft with either the stopper face 41 or the stopper face 42, thus improving the detection accuracy during learning operation.

(4) Also, in the shown embodiment, rotation sensor 31 is configured to detect the rotational position of the rotation shaft 24. The compression ratio reference position learning operation is carried out, based on the detection signal from the rotation sensor, in a state where the control shaft 13 has been mechanically regulated by the high compression ratio side stopper face 42.

On the high compression ratio side, a variation in compression ratio with respect to a rotational angle of control shaft 13 is great. Hence, by executing the learning operation on the high compression ratio side on which a very high compression ratio control accuracy is required, it is possible to improve the control accuracy on the high compression ratio side. Thus, it is possible to suppress knocking from occurring on the high compression ratio side. Additionally, it is possible to suppress the valves and the piston from excessively approaching each other, even on the high compression ratio side that the valves and the piston tend to approach each other.

Also, the variable compression internal combustion engine is configured such that the rotational position of rotation shaft 24 is detected by rotation sensor 31, while regulating the rotational position on the side of control shaft 13. Thus, individual differences of a link length, a shaft hole, a connecting-pin clearance and the like in a power-transmission path between the control shaft 13 and the rotation shaft 24 can be cancelled or absorbed, thereby improving the control accuracy.

Furthermore, during operation at the lowest compression ratio, in which a maximum load is applied, in order to reduce a compression-ratio holding torque of motor 21, it is effective to increase (preferably, to maximize) a reduction ratio between the control shaft 13 and the rotation shaft 24. Assuming that the low compression ratio side stopper face is set on the side of control shaft 13, an excessive motor torque, multiplied owing to an excessive reduction ratio, tends to act on the low compression ratio side stopper face. This may result in abrasion and breakage of the low compression ratio side stopper face. In the shown embodiment, the low compression ratio side stopper face 41 is provided on the side of rotation shaft 24. Hence, there is a less tendency for an excessive torque multiplied at the reduction ratio to be applied the stopper face 41, and thus it is possible to protect the low compression ratio side stopper face 41.

(5) Rotation shaft 24 is set so that the rotation shaft 24 is positioned within a predetermined angular range containing a rotational position such that torque about the rotation shaft, which torque is transmitted from the control shaft 13 through the lever 25 to the rotation shaft 24, becomes a minimum in a state where the rotation shaft 24 has been mechanically regulated by the low compression ratio side stopper face 41. Structurally, the torque about the rotation shaft 24, transmitted from the control shaft 13 through the lever 25 to the rotation shaft 24, tends to decrease, as the angle θ between the link centerline 25A of lever 25 (i.e., the line segment connecting the center of the third connecting pin 28 and the center of the fourth connecting pin 30) and the link centerline 29A of the second arm 29 (i.e., the line segment connecting the center of the journal portion 24A of rotation shaft 24 and the center of the fourth connecting pin 30) decreases. Therefore, For the above reason, in a state where control shaft 13 as well as rotation shaft 24 has been locked up at the low compression ratio side stopper position, the rotation shaft 24 is set such that the rotation shaft 24 is positioned within a predetermined angular range containing a specified position at which the angle θ becomes a minimum (in other words, when the link centerline 25A and the link centerline 29A are brought into line with each other).

Hereby, even when normal compression ratio control becomes disable for some reason during high load operation at which large combustion load is applied or during high speed operation at which large inertial load is applied, after having been reduced to the compression ratio at the low compression ratio side stopper position by virtue of combustion pressure, it is possible to stably hold or maintain the low compression ratio state at the low compression ratio stopper position, while suppressing torque applied from control shaft 13 to the rotation shaft 24. Additionally, even when a fluctuating torque is applied from the control shaft 13 to the rotation shaft 24, it is possible to reduce collision-contact of the rotation shaft 24 with the low compression ratio side stopper face 41, thus suppressing collision noise, caused by the collision-contact, and consequently suppressing the occurrences of abrasion and impression.

(6) A surface accuracy of the high compression ratio side stopper face is set higher than a surface accuracy of the low compression ratio side stopper face. Hence, it is possible to relax the surface accuracy of the low compression ratio side stopper face 41, while ensuring the surface accuracy of the high compression ratio side stopper face 42 used for learning control. For instance, surface finishing of the low compression ratio side stopper face 41 can be eliminated, thereby improving the productivity due to reduced manufacturing man-hour and enabling lower costs.

The invention claimed is:

1. A variable compression ratio internal combustion engine including a control shaft rotatably supported by an engine body, a variable compression ratio mechanism for changing an engine compression ratio in accordance with a rotational position of the control shaft, an actuator that rotatively drives the control shaft, and a speed reducing mechanism for reducing a rotational power of the actuator and for transmitting the speed-reduced power to the control shaft, the speed reducing mechanism having a rotation shaft rotatably supported in a housing fixed to the engine body and a lever that connects the rotation shaft and the control shaft, comprising:

a first regulation part located in the engine body for mechanically regulating the control shaft to a position of maximum rotation on one side of a low compression ratio side and a high compression ratio side; and a second regulation part located in the housing for mechanically regulating the rotation shaft to a position of maximum rotation on the other side of the low compression ratio side and the high compression ratio side.

2. A variable compression ratio internal combustion engine as recited in claim 1, wherein:

the first regulation part is configured to regulate the control shaft to the position of maximum rotation on the high compression ratio side; and the second regulation part is configured to regulate the rotation shaft to the position of maximum rotation on the low compression ratio side.

3. A variable compression ratio internal combustion engine as recited in claim 1, which further comprises:

a rotation sensor for detecting a rotational position of one shaft of the control shaft and the rotation shaft; and a reference position learning means for carrying out compression ratio reference position learning operation, based on a detection signal from the rotation sensor, in a state where the other shaft of the control shaft and the rotation shaft has been mechanically regulated by either the first regulation part or the second regulation part.

4. A variable compression ratio internal combustion engine as recited in claim 3, wherein:

the rotation sensor is configured to detect the rotational position of the rotation shaft; and the reference position learning means is configured to carry out the compression ratio reference position learning operation, based on the detection signal from the rotation sensor, in a state where the control shaft has been mechanically regulated by the first regulation part.

5. A variable compression ratio internal combustion engine as recited in claim 1, wherein:

the rotation shaft is set so that the rotation shaft is positioned within a predetermined angular range containing a rotational position such that torque about the rotation shaft, which torque is transmitted from the control shaft through the lever to the rotation shaft, becomes a minimum in a state where the rotation shaft has been mechanically regulated by the second regulation part.

6. A variable compression ratio internal combustion engine as recited in claim 1, wherein:

the first regulation part has a high compression ratio side stopper face on which a part of the control shaft abuts when the control shaft has been rotated to the position of maximum rotation on the high compression ratio side;

the second regulation part has a low compression ratio side stopper face on which a part of the rotation shaft abuts when the rotation shaft has been rotated to the position of maximum rotation on the low compression ratio side; and a surface accuracy of the high compression ratio side stopper face is set higher than a surface accuracy of the low compression ratio side stopper face.

7. A variable compression ratio internal combustion engine as recited in claim 1, wherein:

the variable compression ratio mechanism comprises:

a lower link rotatably installed on a crankpin of a crankshaft;

an upper link that connects the lower link and a piston of the internal combustion engine; and a control link that connects the control shaft and the lower link.

* * * * *